US006386368B1

(12) United States Patent
Pirro

(10) Patent No.: US 6,386,368 B1
(45) Date of Patent: May 14, 2002

(54) PRODUCT PACKAGING ARRANGEMENT FOR SHIPPING AND DISPLAY

(75) Inventor: Jeffrey P. Pirro, Marcellus, NY (US)

(73) Assignee: Eveready Battery Company, Inc., St. Louis, MI (US)

( * ) Notice: Subject to any disclaimer, the term of this patent is extended or adjusted under 35 U.S.C. 154(b) by 0 days.

(21) Appl. No.: 09/535,569

(22) Filed: Mar. 27, 2000

Related U.S. Application Data

(60) Provisional application No. 60/162,991, filed on Nov. 1, 1999.

(51) Int. Cl.[7] ..... B65D 85/00

(52) U.S. Cl. ..... 206/705; 206/738; 206/806; 206/471

(58) Field of Search ..... 206/703, 704, 206/705, 736, 738, 461, 467, 471, 499, 774, 746, 806; 229/203, 208

(56) References Cited

U.S. PATENT DOCUMENTS

| | | | | | |
|---|---|---|---|---|---|
| 653,086 | A | * | 7/1900 | Houts | 229/208 |
| 2,152,079 | A | * | 3/1939 | Mott | 206/738 |
| 3,599,928 | A | * | 8/1971 | Strong | 206/461 |
| 3,872,966 | A | | 3/1975 | Gordon et al. | |
| 3,918,583 | A | * | 11/1975 | Adams | 206/485 |
| 3,990,578 | A | * | 11/1976 | Roeser | 206/461 |
| 4,582,194 | A | | 4/1986 | Karpiloff et al. | |
| 4,687,094 | A | * | 8/1987 | Allsop et al. | 206/746 |
| 4,779,734 | A | | 10/1988 | Kydonieus | |
| 4,781,289 | A | | 11/1988 | Perkins | |
| 4,784,268 | A | | 11/1988 | Perchak | |
| 4,842,141 | A | | 6/1989 | Segal | |
| 4,852,194 | A | | 8/1989 | Langan | |
| 4,901,858 | A | * | 2/1990 | Anderson | 206/461 |
| 5,012,928 | A | | 5/1991 | Proffitt et al. | |
| 5,052,557 | A | | 10/1991 | Contino et al. | |
| 5,143,215 | A | * | 9/1992 | Hartley et al. | 206/461 |
| 5,259,505 | A | | 11/1993 | Sobel | |
| 5,370,220 | A | * | 12/1994 | Wang | 206/499 |
| 5,411,140 | A | | 5/1995 | Byer | |
| 5,429,233 | A | * | 7/1995 | Juaristi | 206/705 |
| 5,573,117 | A | | 11/1996 | Adams | |
| 5,649,624 | A | | 7/1997 | Seaton | |
| 5,735,404 | A | * | 4/1998 | Kumakura et al. | 206/469 |
| 5,819,939 | A | | 10/1998 | Boyer | |
| 5,878,885 | A | | 3/1999 | Wangu et al. | |
| 5,881,884 | A | * | 3/1999 | Podosck | 206/774 |
| 5,899,333 | A | * | 5/1999 | Williams et al. | 206/469 |
| 5,927,496 | A | | 7/1999 | Seaton et al. | |
| 5,947,297 | A | * | 9/1999 | Aoki et al. | 206/705 |
| 6,135,289 | A | * | 10/2000 | Miller | 206/774 |

FOREIGN PATENT DOCUMENTS

| | | |
|---|---|---|
| FR | 1400046 | 4/1965 |

* cited by examiner

*Primary Examiner*—Paul T. Sewell
*Assistant Examiner*—Shian Luong
(74) *Attorney, Agent, or Firm*—Stewart A. Fraser

(57) ABSTRACT

A shipping and display container having packaged product arranged for shipping and display to consumers that minimizes shipping space and manual handling of the individual packages contained therein. The container has side walls and top and bottom walls defining a compartment and a removable section that is affixed to the container during shipment of the packaged product and is removable to provide an opening for displaying product for sale to consumers. The container further includes a plurality of irregular shaped packaged articles each having a display card and a housing for housing one or more products, wherein the housing has a thickness substantially greater than the thickness of the display card. The arrangement includes an upper packaged article offset and supported on a lower packaged article to provide efficient use of container space.

22 Claims, 3 Drawing Sheets

PRODUCT PACKAGING ARRANGEMENT FOR SHIPPING AND DISPLAY

CROSS-REFERENCE TO RELATED APPLICATION

This application claims the benefit of U.S. Provisional Application No. 60/162,991, filed on Nov. 1, 1999.

BACKGROUND OF THE INVENTION

The present invention generally relates to bulk packaging and display of articles for sale and, more particularly, to a container and packaging arrangement for shipping and displaying irregularly shaped articles, such as packaged batteries, for sale to consumers.

The common practice for displaying small and lightweight retail items, such as alkaline batteries, is to package the items in thermoformed blister card packages and place the blister card packages on shelves or hang the packages on hooks on various display racks. The conventional blister card battery package is composed of a display card which provides a generally stiff supportive backing, usually composed of cardboard, and a thermoformed polymeric blister that is typically heat sealed or otherwise connected to the display card. The display card provides support for displaying the merchandise for sale and contains print and graphics with suitable indicia such as trademarks, advertising, and instructions. The thermoformed blister generally comprises one or more pieces of clear polymeric material, e.g., plastic, that defines a compartment, generally having a shape to fit over and cover the product(s) contained within the package. The blister package isolates the product(s) from the purchaser and prevents inadvertent damage that can result from repeated handling prior to sale, while further allowing for the orderly display of product(s) for sale to consumers.

Blister card packages for containing batteries, as well as other types of products, typically form irregularly shaped articles, since the polymeric blister, which is generally located at one end, is much greater in front-to-rear depth than the display card that extends throughout the remainder of the package. As a result, the blister card package has a lop-sided configuration which makes it difficult to efficiently package bulk articles for shipment from the article manufacturing facility to a promotional display location, such as a retail store, where the packaged articles are placed on display trays or racks for display and sale to consumers.

It has been common practice for irregularly shaped blister card packages to be shipped in bulk in rectangular cardboard shipping containers with the blister card packages arranged in a staggered reverse orientation in which the narrow part of one package is juxtaposed with the wide part of an adjacent package to minimize volume consumption. However, when the shipping container is opened at the retail store to display the packages, the blister packages must be individually handled by store personnel to place the individual packages on the display trays or display racks. The manual handling includes arranging the individual packages so that the packages are oriented in the same direction and the graphics on each display card are displayed to face the consumers. The conventional approach for displaying irregularly shaped packaged products therefore involves manual handling which is generally time consuming and costly. Additionally, the shipping container is generally discarded once the blister card packages are manually relocated for display on the display trays or racks.

Accordingly, there is a need, heretofore unfulfilled, for a relatively inexpensive and easy to use container for shipping and displaying packaged products for sale and display to consumers in a manner that minimizes or eliminates the manual handling of individual articles, and offers efficient use of space. There is a further need to provide for such a container for shipping and displaying blister card packages, such as those containing batteries, which have an irregularly shaped package configuration.

SUMMARY OF THE INVENTION

The present invention provides for a product shipping and display container that houses packaged products arranged for shipping and display to consumers which offers efficient shipping space consumption and minimizes manual handling of the individual packages. To achieve this and other advantages, and in accordance with the purpose of the present invention as embodied and described herein, the present invention provides for a container having side walls and top and bottom walls defining a compartment, and removable material engaging the container to retain packaged articles during shipment of the packaged articles and removable to provide a dispensing opening for displaying the packaged articles for sale to consumers. The container contains a plurality of packaged articles each having a display card and a housing for housing one or more products, wherein the housing has a thickness substantially greater than the thickness of the display card. The packaged articles are arranged in the container with upper and lower packages, wherein an upper packaged article is offset and supported on a lower packaged article to provide efficient use of space in the container. Articles may be individually removed from the container through the dispensing opening.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
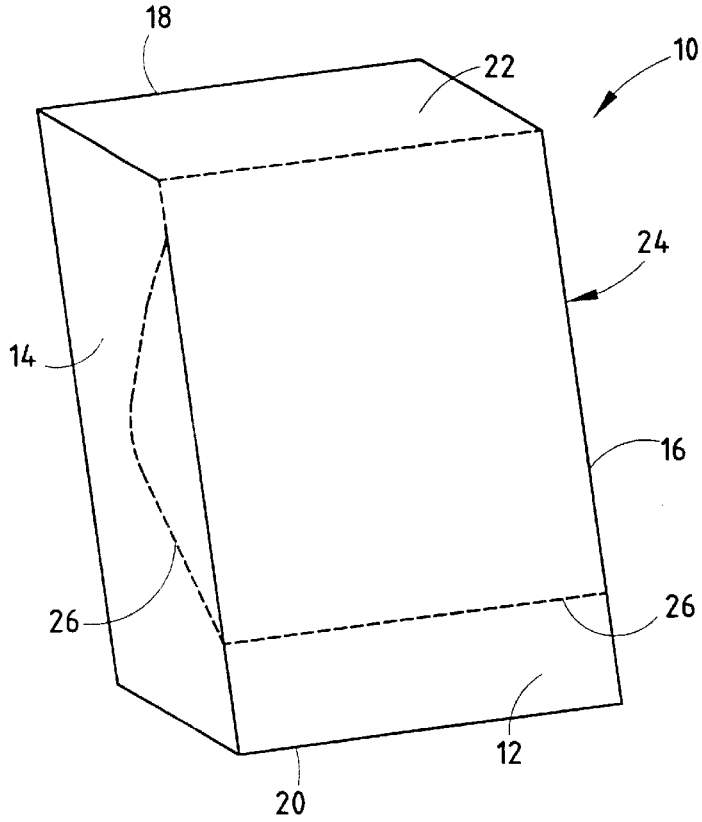
FIG. 1 is front perspective view of a container for shipping and displaying packaged products for sale according to the present invention.

For purposes of description herein, the terms "upper," "lower," "right," "left," "rear," "front," "vertical," "horizontal" and derivatives thereof shall relate to the invention as oriented in FIG. 1. However, it is to be understood that the invention may assume various alternative orientations and step sequences except where expressly specified to the contrary. It is also to be understood that the specific devices illustrated in the attached drawings, and described in the following specification is simply an exemplary embodiment of the inventive concept defined in the appended claims. Hence, specific dimensions and physical characteristics relating to the embodiment disclosed herein is not to be considered as limiting, unless the claims expressly state otherwise.

Referring to FIG. 1, a product shipping and display container 10 is shown for containing a plurality of irregularly shaped packages, such as AA-size battery packages, for both shipping to retail stores and for promotional display to consumers in the retail stores. According to the specific example shown, the shipping and display container 10 is designed to house twelve battery packages, each package containing four AA-size batteries. The battery packages are efficiently arranged in container 10 to minimize volume consumption and are ready for display without requiring rehandling of individual packages. While the container 10 is shown and described in connection with a battery shipping and display container for housing AA-size batteries, it should be appreciated that the container 10 may be employed to ship and display various types, sizes and numbers of irregularly shaped articles in accordance with the teachings of the present invention.

The shipping and display container 10 is generally rectangular in shape, having six walls defining a compartment for containing the packaged articles. The walls include upstanding front wall 12, upstanding left side wall 14, upstanding right side wall 16, upstanding rear wall 18, lower wall 20 at the bottom, and upper wall 22 at the top. Container 10 is shown standing upright supported on the horizontally oriented bottom lower wall 20; however, container 10 is preferably tilted towards the rear wall 18 during display of the packaged products for sale to consumers. It should be appreciated that the container 10 may be moved into various positions during shipping and prior to display.

Figure 2:
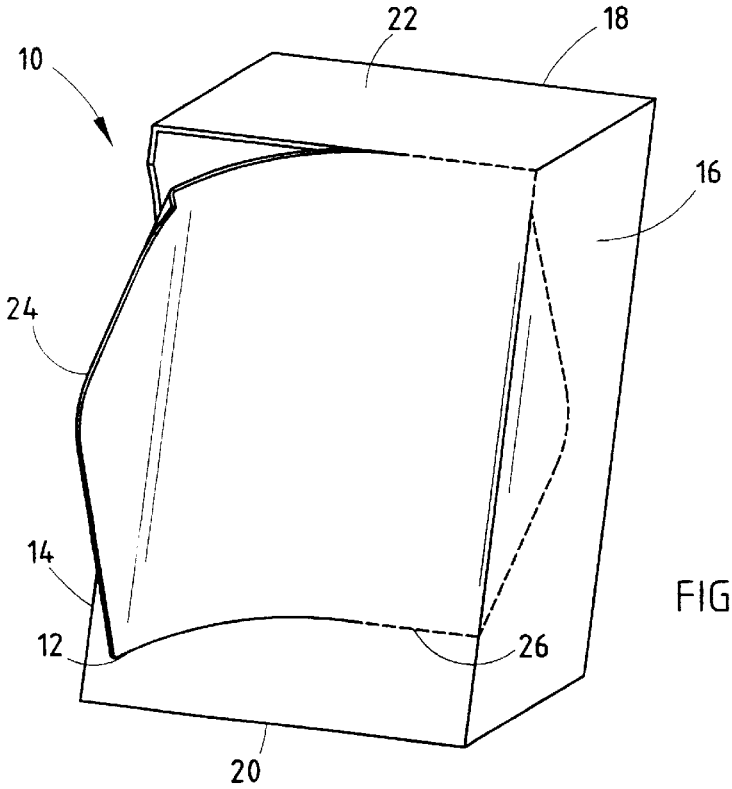
FIG. 2 is a front perspective view of the container shown partially opened.

Formed in the side walls 14 and 16 and front wall 12 are perforations 26 which define a removable tear section 24. Removable tear section 24 may be torn open at perforations 26 and removed from container 10 to provide a dispensing opening that allows for display of the packaged articles and removal of the packaged articles by consumers. The tear section 24 includes a substantial area of front wall 12, with the exception of the lower region which remains on the container 10 and is well suited to contain graphics or print such as battery size, trademark, and other indicia. The tear section 24 also includes a section, preferably towards the front side, of each of side walls 14 and 16 to allow easy rearward access at either side of the packages by a consumer. It should be appreciated that personnel in retail stores may easily remove the tear section 24 as shown in FIG. 2 by tearing along the perforations 26 in order to ready the container 10 and its packaged articles for display.

The removable tear section 24 serves as a removable material that engages the container during shipment of the packages and is removable to provide a dispensing opening for displaying the packages for sale to consumers. While a removable tear section 24 is shown and described herein, it should be appreciated that other removable materials may be employed to retain the packages in the container 10 during shipment. According to another embodiment, the removable material may include an outer wrapping, such as a sheet of clear polymeric material, enclosing the container 10 and blocking the dispensing opening to retain the packages therein, with the wrapping being removable to expose the dispensing opening during display. According to a further embodiment, the removable material may include a band, made up of polymeric material, cardboard, or other material extending around the front and rear walls 12 and 18 and left and right side walls 14 and 16 and at least partially cover the dispensing opening to thereby retain product in the container 10 during shipment, and being tearable to remove the band from the dispensing opening and expose the packages for displaying and dispensing. According to yet a further embodiment, the container 10 may be configured as a two-piece box generally having a box for providing left and right upstanding walls 14 and 16, rear upstanding wall 18, and lower and upper walls 20 and 22, and a removable cover providing the front upstanding wall 12, with the cover being removable to provide the dispensing opening.

Figure 3:
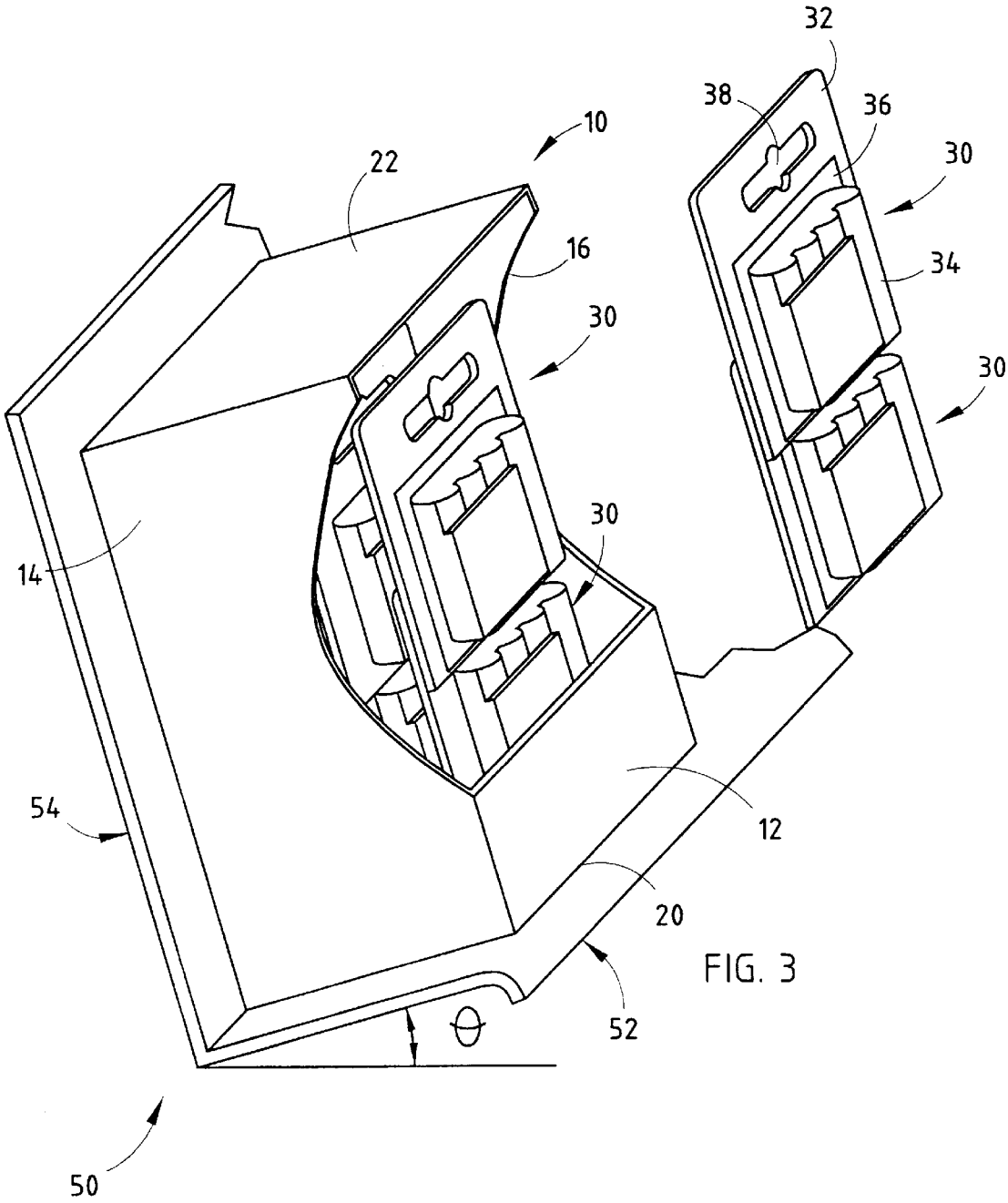
FIG. 3 is a perspective view of the fully opened container shown on a display shelf for displaying packaged articles, and further shows a pair of packaged articles removed.

Referring to FIG. 3, the shipping and display container 10 is shown located on a store display 50 with the tear section 24 completely removed so as to display the packaged articles for sale to consumers. The display 50 generally includes a shelf 52 for supporting the bottom wall 20 and an upstanding back support 54 for supporting the rear wall 18. The shelf 52 is preferably raised at its outer edge so that it is angularly tilted at an angle θ in the range of 20 degrees to 30 degrees relative to the horizontal plane. Packaged articles, such as battery packages 30 containing battery product, are efficiently arranged within the container 10 for display to consumers. The battery packages 30 are arranged in container 10 in an efficient manner that consumes a small amount of volume, and yet offers the packages 30 ready for display following shipment without requiring manual reorientation of the packages 30. This is because all of the battery packages 30 are arranged in container 10 facing the front wall 12 and are therefore readily viewable to consumers.

Packages 30 are arranged in container 10 to include upper packages supported on lower packages. Each upper package is slightly offset and disposed on a lower package. Adjacent pairs, made up of an upper package and an adjacent lower package, are stacked one pair behind the other to substantially fill the volume of container 10. It should be appreciated that by tilting the container 10 at angle θ, the packages 30 at the front side rest partially on the rearward packages to enhance stability of the package arrangement.

Figure 4:
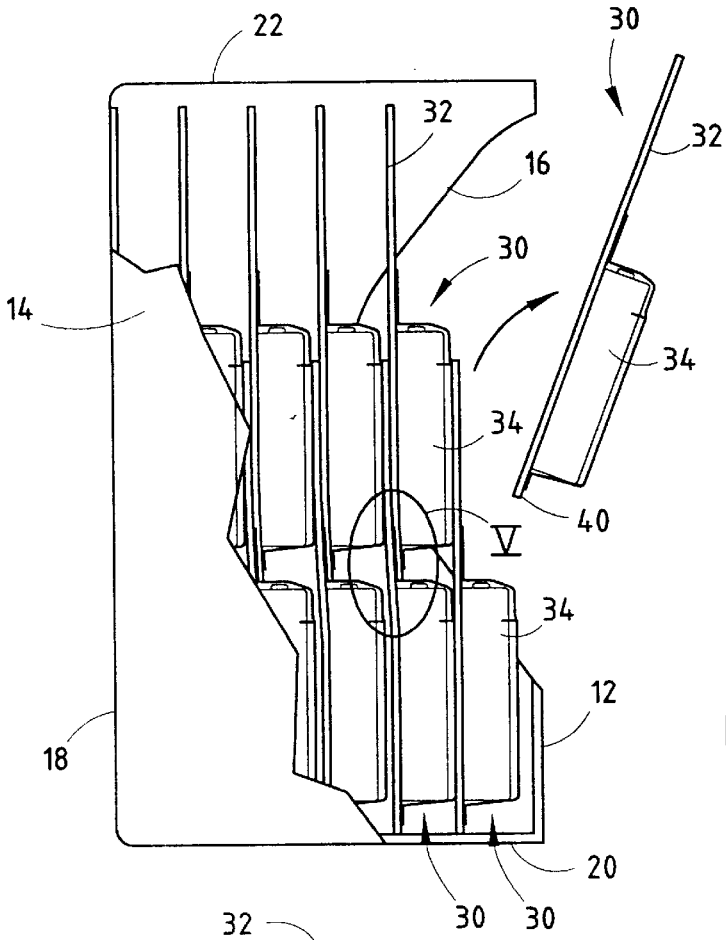
FIG. 4 is a side elevational view, partially broken away, of the container further illustrating the arrangement of the packaged articles.

As shown in FIG. 4, battery package 30 includes a display card 32 and a thermoformed blister 34 heat sealed or otherwise bonded to the display card 32. Blister 34 is closed against display card 32 to define a closed compartment for storing one or more products, such as batteries. Alternately, the blister 34 alone may define a closed compartment for containing the product(s). The blister 34 is generally located near the lower edge 40 of the battery package 30 and has a thickness, i.e., front-to-rear distance, substantially greater than the thickness of the display card 32. As a consequence, battery package 30 has a non-uniform, i.e., irregular shape. Display card 32 is preferably made of cardboard, according to one example; however, display card 32 may be made of other materials, such as paperboard or polymeric materials. The display card 32 may include graphics and print for providing indicia such as product description, advertisement, and instructions. Blister 34 is preferably made of a thermoformed polymeric material as is generally known in the art; however, alternate housing materials, such as injection molded polymeric material, may also form the product housing.

Figure 5:
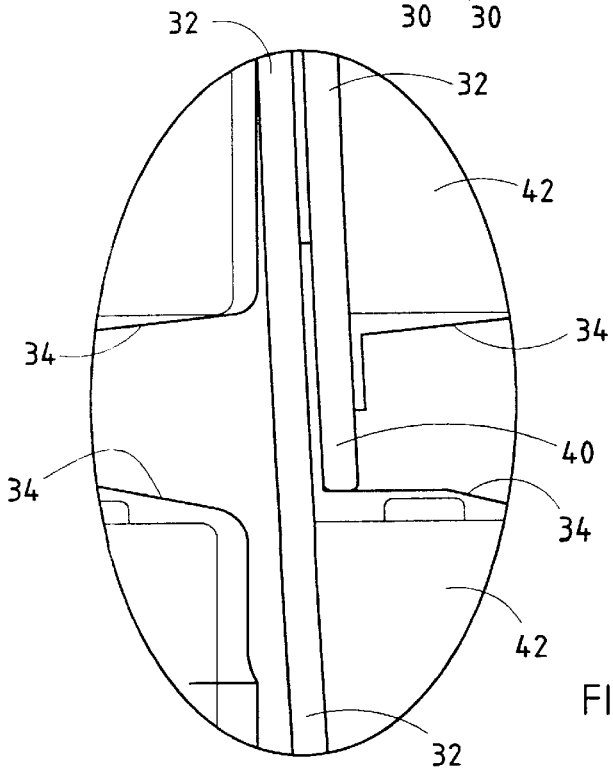
FIG. 5 is an enlarged view of section V in FIG. 4.

The lower edge 40 of each of the lower battery packages 30 rests on top of the bottom or lower wall 20 of container 10. Each of the upper packages 30 are efficiently disposed in the container 10 such that its lower edge 40 rests on top of the thermoformed blister 34 of a lower package 30 to provide a double-stacked arrangement of packages. With particular reference to FIG. 5, the lower edge 40 of an upper package 30, containing batteries, 42, is shown resting on top of the upper surface of the blister 34 of a lower package 30, which likewise houses batteries 42. While the lower edge 40 of display card 32 is shown formed as a continuation of the display card 32, it should be appreciated that the lower edge 40 of package 30 may be provided by the polymeric thermoformed blister, according to another embodiment. Additionally, while a double stacked arrangement of packages 30 is shown, it should also be appreciated that other multiples of packages may be stacked to include three or more packages located one on top of another, e.g., triple-stacked, quadruple-stacked, etc.

Accordingly, the shipping and display container 10 of the present invention efficiently contains packaged products for shipping and display to consumers in a retail store without requiring rehandling of the individual packaged products following shipment. Further, the arrangement of the container 10 and plurality of packaged products provides improved product density at the retail store. According to the example shown, the container 10 is preferably located on a tilted shelf for display to consumers. However, it should be appreciated that the container 10 may be otherwise configured to provide a built-in support stand or may include a non-rectangular shape having an integral tilted orientation formed therein.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A combination container and arrangement of packaged articles for shipment and display to consumers comprising:

a container having side walls and top and bottom walls defining a compartment, said container further having a removable material engaging said container to retain packaged articles during shipment of the packaged articles and removable to provide an opening in a front wall of the container for displaying the packaged articles for sale to consumers; and a plurality of packaged articles arranged facing frontwardly in said container towards said front wall such that the plurality of packaged articles are viewable via the opening once the removable material is removed, each of said packaged articles having a display card and a housing for housing one or more products, and said housing having a frontwardly extending surface and at least a portion of the housing having a thickness substantially greater than the thickness of said display card, wherein said packaged articles include an upper packaged article offset and supported on the frontwardly extending surface of the housing of a lower packaged article and accessible via the opening for display to consumers.

2. The combination container and packaged articles as defined in claim 1, wherein said packaged articles are irregularly shaped articles having a front-to-rear thickness that varies.

3. The combination container and packaged articles as defined in claim 1, wherein said container is generally rectangular in shape.

4. The combination container and packaged articles as defined in claim 1, wherein said container comprises cardboard.

5. The combination container and packaged articles as defined in claim 1, wherein said packaged articles comprise battery packages containing one or more batteries.

6. The combination container and packaged articles as defined in claim 5, wherein each of said packaged articles comprises a blister for containing one or more products sealed to a display card.

7. The combination container and packaged articles as defined in claim 1, wherein said housing comprises a thermoformed blister.

8. The combination container and packaged articles as defined in claim 7, wherein said upper package rests on said thermoformed blister of the lower package.

9. The combination container and packaged articles as defined in claim 1, wherein said removable material comprises a removable section formed in said container.

10. The combination container and packaged articles as defined in claim 9, wherein said removable section comprises perforations formed in said container so that the removable section can be torn from the container.

11. A combination container and packaged batteries for shipment and display to consumers comprising:

a container having side walls and top and bottom walls defining a compartment, said container further having removable material engaging said container to retain packaged batteries during shipment of the battery packages and removable to provide an opening in a front wall of the container for displaying the packaged batteries; and a plurality of battery packages arranged facing frontwardly in the container towards the front wall such that the plurality of battery packages are viewable via the opening once the removable material is removed, each battery package having a display card and a housing for housing one or more batteries and said housing having a frontwardly extending surface and at least a portion of the housing having a thickness substantially greater than the thickness of said display card, wherein said packaged batteries include an upper battery package offset and supported on the frontwardly extending surface of the housing of a lower battery package and said battery packages are accessible via the opening for sale to consumers.

12. The combination container and packaged batteries as defined in claim 11, wherein each of said battery packages are irregularly shaped having a front-to-rear thickness that varies.

13. The combination container and packaged batteries as defined in claim 11, wherein said container is generally rectangular in shape.

14. The combination container and packaged articles as defined in claim 11, wherein said removable material comprises a removable section provided in the container.

15. The combination container and packaged batteries as defined in claim 14, wherein said container comprises perforations that define the removable section, wherein said perforations are torn to remove the removable section.

16. The combination container and packaged batteries as defined in claim 11, wherein said housing comprises a thermoformed blister.

17. A method of shipping and displaying packaged articles for sale to consumers comprising the steps of:

disposing a plurality of packaged articles in a container having a compartment defined by side walls and top and bottom walls, each of said packaged articles having a display card and a housing for housing one or more products, and said housing having a frontwardly extending surface and at least a portion with a thickness substantially greater than the thickness of said display card, wherein said packaged articles are arranged facing frontwardly in the container towards a front wall of the container and are arranged to include an upper packaged article offset and supported on the frontwardly extending surface of the housing of a lower packaged article;

shipping said packaged articles in said container to a retail outlet; and removing a removable material that is engaged with said container for retaining the packaged articles to provide an opening in the front wall of the container to display said packaged articles for display and sale to consumers.

18. The method as defined in claim 17 further comprising the step of locating said container on a display stand.

19. The method as defined in claim 17 further comprising the steps of selectively removing one or more packaged articles from said container through said opening.

20. The method as defined in claim 17 further comprising the step of forming each of said plurality of packaged articles by disposing a product in a housing and attaching the housing to a display card to form an irregularly shaped article.

21. The method as defined in claim 17, wherein said packaged articles comprise battery packages.

22. The method as defined in claim 17 further comprising the step of forming a removable section in said container by forming perforations to define said removable section as the removable material.

* * * * *